US005755499A

United States Patent [19]

Hillesland

[11] Patent Number: 5,755,499

[45] Date of Patent: May 26, 1998

[54] REMOTE CONTROL HOLDER

[76] Inventor: Norman C. Hillesland, 3308 Brookview Dr., Burnsville, Minn. 55337

[21] Appl. No.: 687,057

[22] Filed: Aug. 7, 1996

[51] Int. Cl.[6] ..... A47B 97/00

[52] U.S. Cl. ..... 312/272.5; 312/328; 312/245; 312/309; 312/271

[58] Field of Search ..... 312/271, 272, 312/272.5, 245, 306, 309, 327, 328

[56] References Cited

U.S. PATENT DOCUMENTS

| | | | |
|---|---|---|---|
| 353,774 | 11/1886 | Berge | 312/272.5 |
| 445,861 | 2/1891 | Richards | 312/309 X |
| 654,922 | 7/1900 | Schipkowsky | 312/272.5 X |
| 1,556,353 | 10/1925 | Roedding . | |
| 2,299,409 | 10/1942 | Rathburn | 312/328 X |
| 2,316,632 | 4/1943 | Smart | 312/272.5 |
| 2,391,453 | 12/1945 | Goldbert | 312/272.5 X |
| 2,570,054 | 10/1951 | Gardner . | |
| 2,631,914 | 3/1953 | Garder | 312/272.5 |
| 2,846,287 | 8/1958 | Gardner | 312/309 |
| 2,865,700 | 12/1958 | Myers | 312/309 |
| 5,090,785 | 2/1992 | Stamp | 312/328 X |
| 5,570,938 | 11/1996 | Butler | 312/245 X |

*Primary Examiner*—Peter M. Cuomo
*Assistant Examiner*—James O. Hansen
*Attorney, Agent, or Firm*—Patterson & Keough, P.A.

[57] ABSTRACT

A device for separately storing items which are intended to be used together. The device has a pivotable front wall which exposes items stored therewithin when opened. As the pivotable front wall is opened, a linkage assembly between the pivotable frontwall and an elevating platform simultaneously raises an elevating platform and contents stored thereon, thereby allowing access to these items.

7 Claims, 4 Drawing Sheets

REMOTE CONTROL HOLDER

FIELD OF THE INVENTION

This invention relates to storage devices and more particularly to storage devices which expose more than one storage compartment when opened by a single motion.

BACKGROUND

Devices for storing items such as magazines, documents, working papers, files, calculators, slide rules and television remote controls are known.

U.S. Pat. No. 2,631,914 discloses a cabinet that enables storage of magazines and other items as well as ashtrays within receptacles which are not visible until a user opens a side door. Some of the magazine receptacles are located on the insides of side doors. Other storage receptacles for magazines, ashtrays and the like are situated in the interior of the cabinet, their upper edges attached to the lower edge of the cabinet top member. When a user desires to retrieve items stored therewithin, a side door is tilted open thereby accessing the stored magazines. Mechanical linkages attached to the side door simultaneously raise the interior receptacles upwards, through openings in the cabinet top member. The tops of the receptacles thereby force open hinged lids which are otherwise closed. While handy to store items from view and retrieve them later, this cabinet does not offer the facility of being mounted in convenient places such as walls and in vehicles. Moreover, the cabinet is not intended to be moved about easily to new, more convenient locations, nor is the cabinet inexpensive. Thus, there is a need for a convenient, inexpensive device to separately store items which are often used together.

SUMMARY OF THE INVENTION

The present invention provides a device for separately storing items which are intended to be used together, and then opening both storage compartments simultaneously when these items are to be retrieved. It is an object to provide a mountable storage device with a plurality of storage compartments. The storage compartments include a front and a rear storage compartment. The front storage compartment has a pivotally movable frontwall. The rear storage compartment is adjacent to the front storage compartment and has an elevating platform therewithin. The elevating platform is connected to the movable frontwall by means of a linkage assembly so that the elevating platform rises as the movable frontwall is pivoted away from the front storage compartment.

DETAILED DESCRIPTION OF THE DRAWINGS

Figure 1:
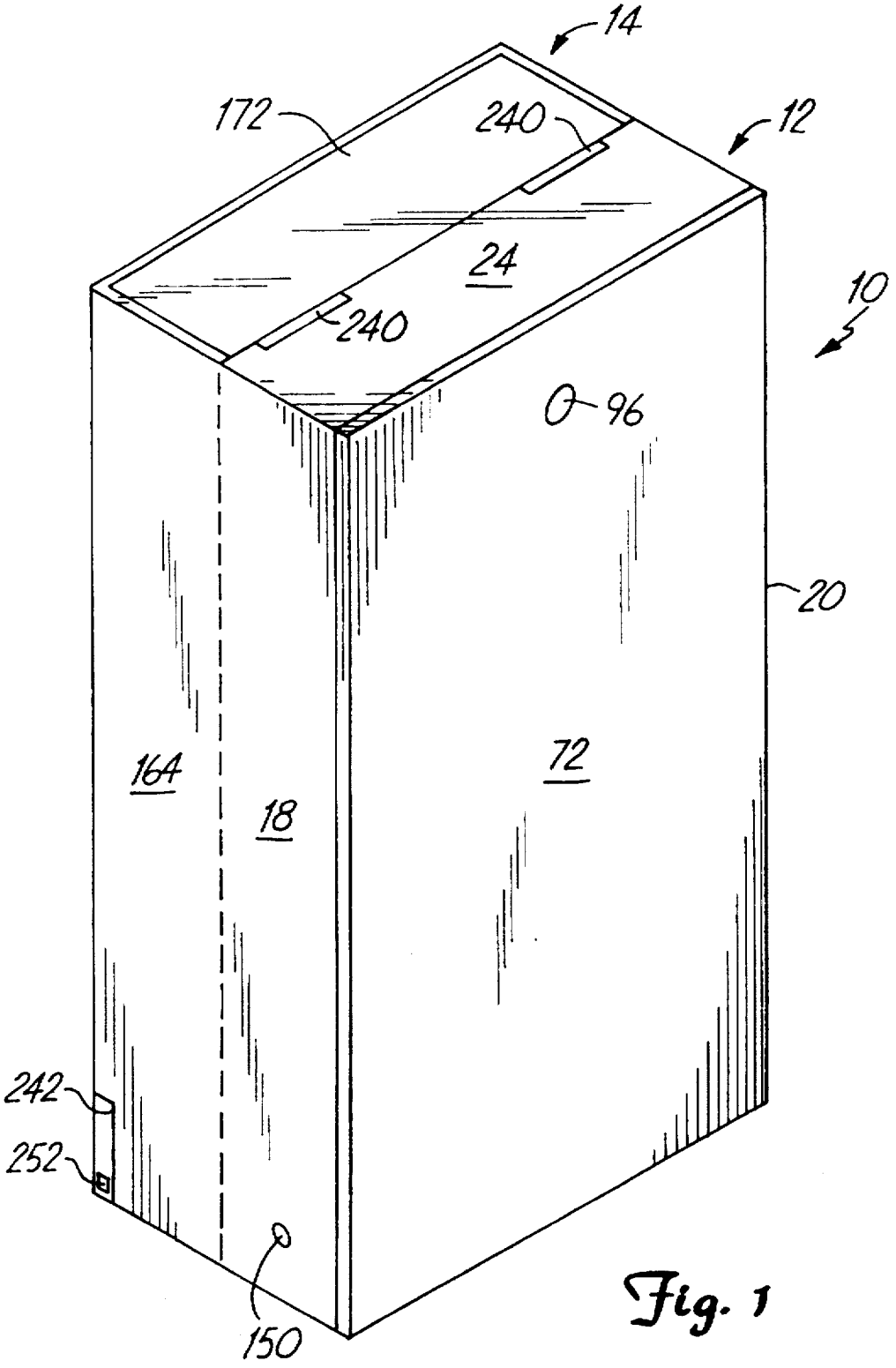
FIG. 1 is a elevated right perspective view of a mountable storage device of the present invention.
Figure 2:
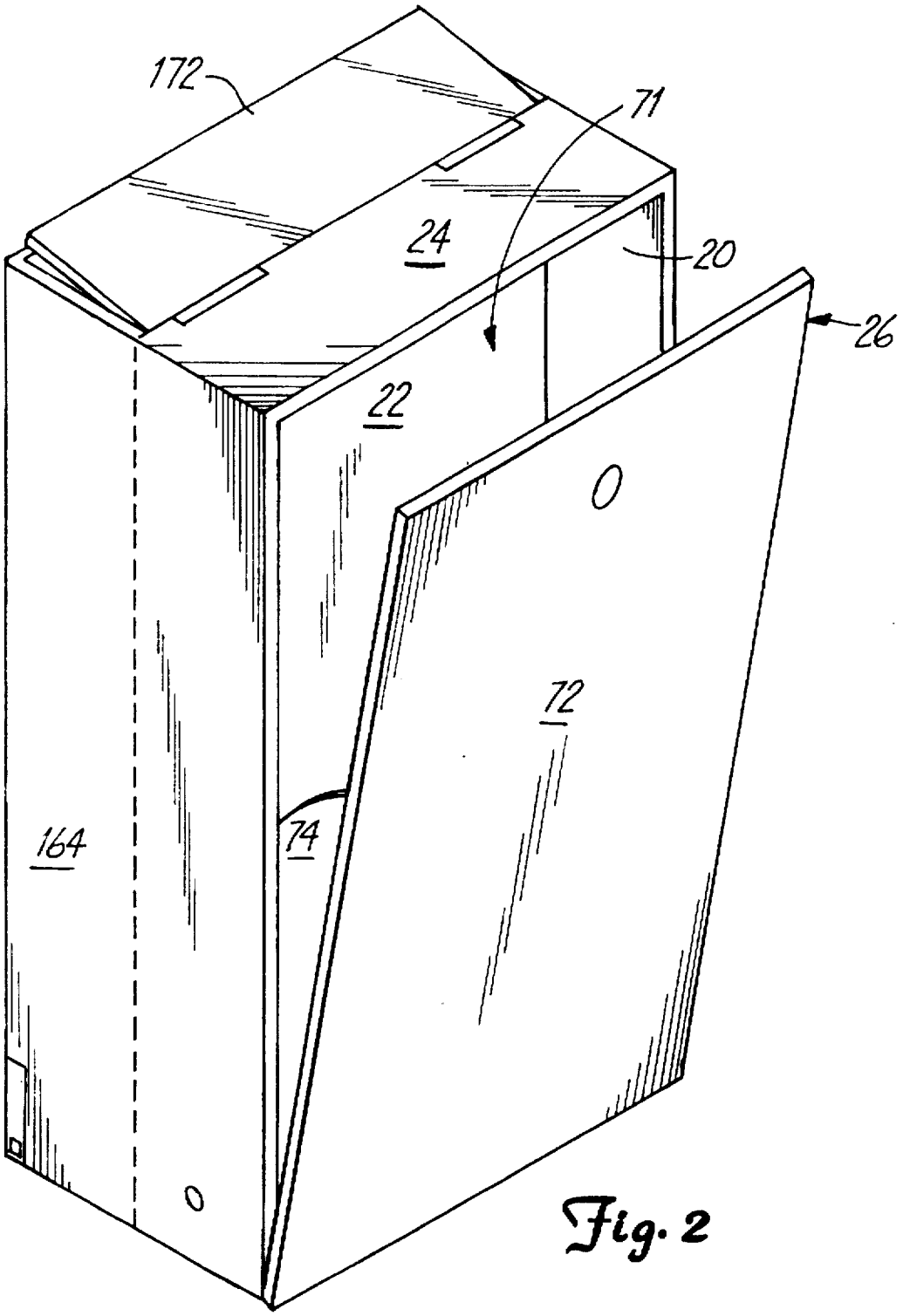
FIG. 2 is an elevated right perspective view of the present invention with a front storage compartment partially pivoted away and a lid covering a rear storage compartment partially opened.
Figure 3:
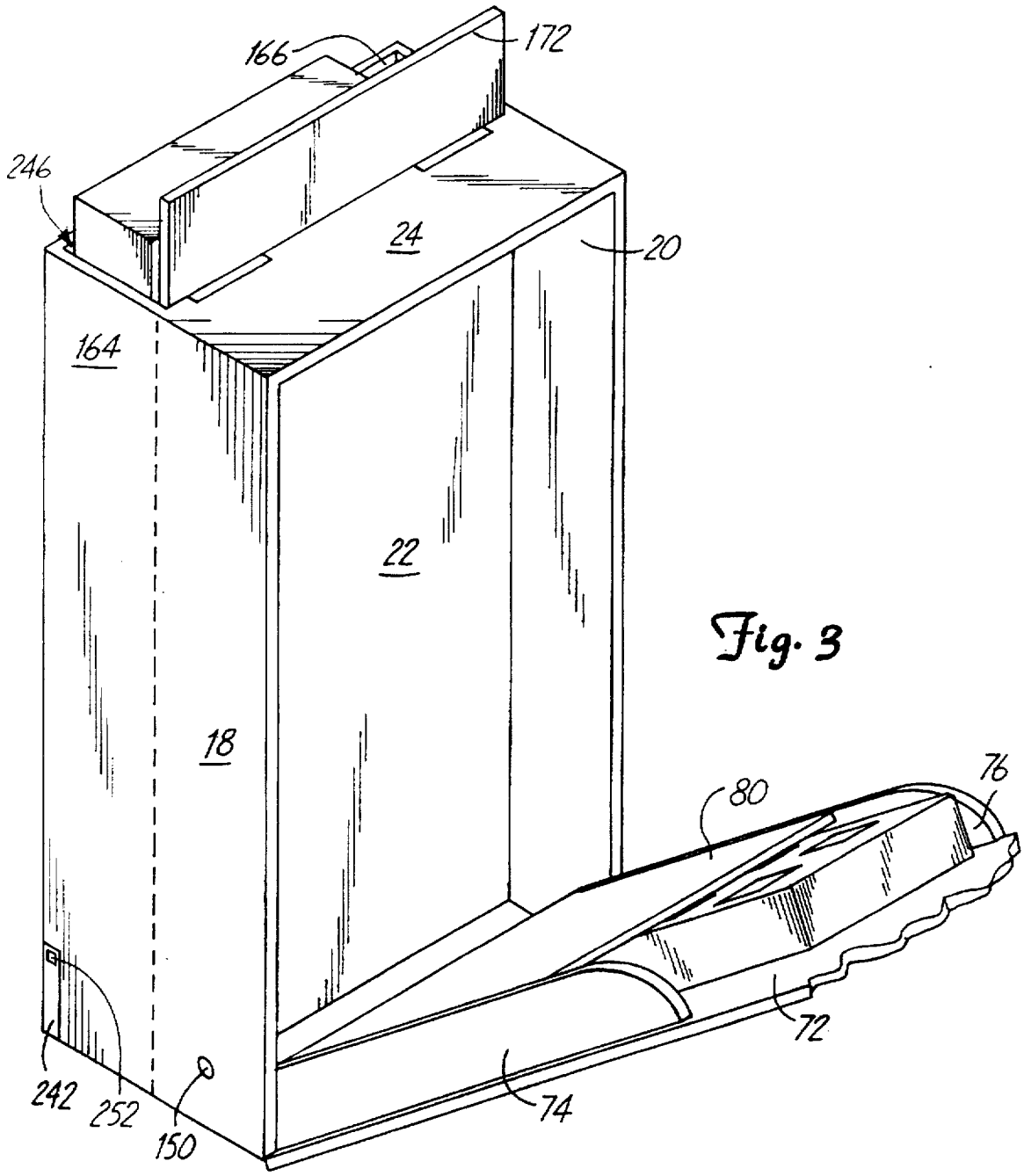
FIG. 3 is an elevated right perspective view of the present invention with the front storage compartment completely pivoted, exposing its contents, the lid covering the rear storage compartment completely opened, and the raised, stored contents in the rear storage compartment exposed to view.

Comprehension of the present invention can be gained through reference to the drawings in conjunction with a thorough review of the following explanation. In order to facilitate a full appreciation of the invention, an overview of the preferred embodiment is initially provided. The overview is followed by more detailed explanation.

A mountable storage device 10 of the present invention includes pivotable front storage compartment 12, rear storage compartment 14 and linkage assembly 16. Front storage compartment 12 includes sidewalls 18, 20, rearwall 22, topwall 24 and pivotable frontwall assembly 26. Sidewalls 18, 20, rearwall 22 and topwall 24 define a front cavity 71. In the preferred embodiment of the present invention, pivotable frontwall assembly 26 includes frontwall 72, sidewalls 74, 76, floor 78, keeper wall 80 and one or more partitions. It should be noted that keeper wall 80 could be replaced by an elastic band or other strap, or removed entirely without departing from the spirit or scope of the present invention. Rivets or pivot pins 150 pivotally join sidewalls 74, 76 to sidewalls 18, 20, respectively. Pivotable front wall assembly 26 is thereby disposed within front cavity 71 when not in an open position. An opening 96 is provided on frontwall 72 to facilitate the moving of front wall 72. Alternatively, a handle or a knob may be mounted on frontwall 72 in place of opening 96. In another embodiment, one or more holes (not shown) suitable for mounting on a wall are present within frontwall 72.

Figure 4:
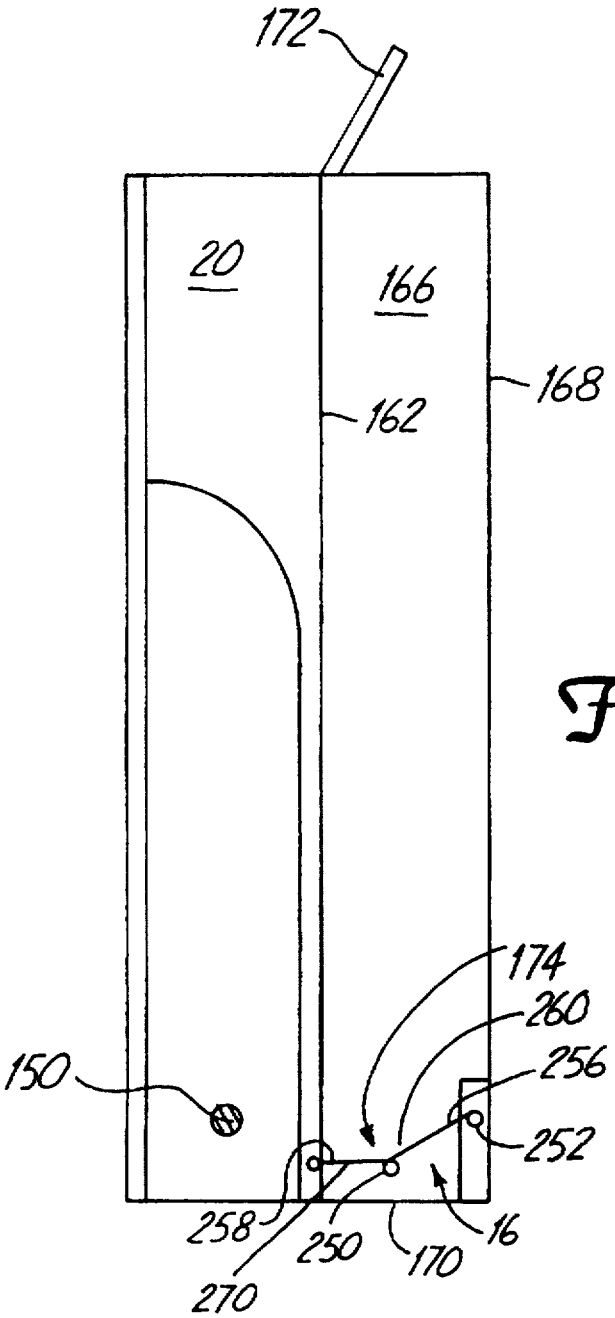
FIG. 4 is a side plan view showing the front storage compartment and linkage in phantom and the lid partially opened.

Rear storage compartment 14 includes rearwall 162, sidewalls 164, 166, frontwall 168, floor 170, lid 172 and platform assembly 174. In the preferred embodiment, frontwall 168 of rear storage compartment 14 and rear wall 22 of pivotable front storage compartment 12 are one and the same. The bottom edges of frontwall 168 and rearwall 22 are a distance from floor 170, thereby forming an opening therebetween. In an alternate embodiment, frontwall 168 and rearwall 22 are separate walls mounted together. In yet another alternate embodiment, frontwall 168 and rearwall 22 are separated by spacers (not shown). In the preferred embodiment of the present invention, a pair of hinges 240 are used to pivotably mount lid 172 to top wall 24. However, other devices, such as a single continuous hinge or a strip of pliable materials such as cloth or canvas may be used without departing from the spirit or scope of the present invention. Lowermost portions of sidewalls 164, 166 are vertically notched as illustrated in FIG. 4, thereby forming slotted openings 242, 244 for receiving guide members as will be discussed in greater detail below. Floor 170, rearwall 162, frontwall 168, sidewalls 164, 166 and lid 172 define rear storage cavity 246. In another embodiment, a ring (not shown) or other grasping object may be mounted on an upper portion of the outside surface of rearwall 162. In the preferred embodiment, rearwall 162 includes at least one mounting hole therein.

In the preferred embodiment, the mounting holes are formed in rearwall 162 which is mounted to a wall or other suitable surface. Device 10 is thus opened by inserting a digit or some object in opening 96, then pivoting frontwall 72 away from the remainder of device 10. In another embodiment, the mounting holes are formed in frontwall 72 which is mounted to a wall or other suitable surface.

Platform assembly 174 includes hinge 250 and guide member 252. Hinge 250 includes front edge 256 and rear edge 258. Hinge 250 further includes hinged middle portion 260. Guide member 252 is ideally a rod or elongated member and attaches to rear edge 258 of hinge 250 and spans slots 242, 244. In place of hinge 250, a pliable material such as cloth or a synthetic resin may be used. A pair of tabs extending from the lateral edges of hinge 250 could also be used in place of guide member 252 without departing from the spirit or scope of the present invention.

In the preferred embodiment of the present invention, linkage assembly 16 includes pliable member 270. Pliable member 270 attaches to front edge 256 of hinge 250 and extends through the opening between the bottom edges of frontwall 168, rearwall 22 and floor 170 to be joined to a lower portion of keeper wall 80. Alternatively, pliable member 270 may be joined to the junction of frontwall 72 and floor 78 of pivotable frontwall assembly 26. Pliable member 270 is ideally cloth or a vinyl substance as is known to the art. However pliable member 270 may also include a plurality of strings or chains made of metal, plastic or another suitable material.

In the preferred embodiment, storage device 10 may be mounted on a wall or other suitable surface by means of mounting holes disposed in either frontwall 72, or rearwall 162. Device 10 is thus opened by grasping a ring (not shown) mounted on the outside surface of rearwall 162 and pivoting the entire device away from frontwall 72.

As the upper portion of pivotable frontwall assembly 26 pivots out and down, a lower portion thereof pivots into the opening between floor 170 and the lower edge of frontwall 168 and rearwall 22. The attached linkage assembly is pulled generally upwardly and outwardly. The generally upward and outward movement of linkage assembly 16 also pulls attached hinge 250 in a generally upwardly direction. Hinge 250 is confined to an upward direction due to confinement of guide 252 attached thereto. Guide 252 is movable only within the confines of slots 242, 244. As pivotable wall assembly 26 becomes further pivoted away from the remainder of storage device 10, an item such as remote control 280 is exposed. Simultaneously, an item such as a magazine 282, which normally resides within rear storage cavity 246 on top hinge 250, is thereby raised, displacing lid 172, if magazine 282 is of sufficient height. When storage device 10 is in an open position, stored contents may be retrieved and other items to be stored may be placed within the storage cavities of storage device 10. When storage device 10 is closed, pivotable frontwall assembly 26 is pivoted back into front cavity 71. The attached linkage assembly is also lowered, thereby lowering hinge 250 and the contents disposed thereon. As the contents disposed upon hinge 250 are being lowered, lid 72 is also allowed to return to its lowered position. Alternatively, lid 72 may also be lowered by the tension exerted by a spring or rubber band.

By way of illustration and not limitation, the preferred embodiment of storage device 10 is approximately 20.8 cm in height, 14 cm in width and 6.4 cm in depth. Pivotable front storage compartment 12 and rear storage compartment 14 are approximately 3.4 cm and 3.0 cm in depth, respectively, sidewalls 74, 76 are approximately about 7 cm high, slots 242, 244 are approximately 0.3 cm in width and 3.5 cm in depth, opening 227 is approximately about 3.5 cm in height and lid 172 is approximately 3.1 cm in length. In an alternative embodiment, a gap of approximately 0.3 cm is present between front and rear storage compartments 12, 14. The gap is maintained by a plurality of spacers (not shown).

In an another alternative embodiment, platform assembly 174 may be elevated by a battery powered, direct current motor or hydraulics (not shown) as opposed to a mechanical linkage. An electronic sensor (not shown) may be provided to sense when front wall 72 is being opened or closed. The sensor would then actuate a motor or hydraulic system to elevate or lower the platform.

In addition to being mounted on a wall for use, storage device 10 may be mounted on a stand (not shown) to impart lateral stability. If mounted on a stand, storage device 10 would be suitable for use on a table top or other horizontal surface.

Suitable materials for making the wall and floor portions of storage device 10 include wood, artificial resins, extruded graphite, steel and aluminum, as well as other materials known to the art. Suitable materials for making hinges 240, 250 are steel, aluminum or other known substances. Guide 252 may be constructed from wood, synthetic resin or other known materials with requisite stiffness.

Because numerous modifications of this invention may be made without departing from the spirit thereof, the scope of the invention is not to be limited to the embodiments illustrated and described. Rather, the scope of the invention is to be determined by appended claims and their equivalents.

What is claimed is:

1. A mountable storage device having a plurality of storage compartments, comprising:

a front storage compartment, wherein the front storage compartment has a pivotally movable frontwall assembly;

a linkage assembly affixed to the frontwall assembly; and a rear storage compartment adjacent to the front storage compartment, wherein the rear storage compartment has two sidewalls a backwall and a guide wherein each rear storage compartment sidewall defines a laterally disposed slot formed therein and wherein the guide spans the pair of slots and wherein the rear storage compartment has an elevating platform assembly having at least two hinged members wherein the platform assembly is connected to the frontwall assembly via the linkage assembly, such that the elevating platform assembly rises as the frontwall assembly is pivoted away from the front storage compartment.

2. The storage device of claim 1, further comprising a lid pivotally mounted to an upper surface of the rear storage compartment.

3. The storage device of claim 1, wherein the guide is an elongated member.

4. A mountable storage device having a plurality of storage compartments, comprising:

front storage means for storing a first set of items wherein the front storage means incudes a frontwall assembly having an elastic strap retention means and a pivot means for pivoting frontwall assembly thereon;

linkage means; and rear storage means mounted to the front storage means for storing a second set of items, wherein the rear storage means includes an elevating platform means linked to the frontwall assembly such that when the frontwall assembly is pivoted away from the storage means the platform means elevates.

5. A mountable storage device, comprising:

a front storage compartment having a pivotable frontwall assembly, a backwall, a topwall and first and second sidewalls, wherein the frontwall assembly includes a frontwall, and a retention assembly;

a linkage assembly connected to the frontwall assembly; and a rear storage compartment adjacent the front storage compartment having third and fourth sidewalls, a frontwall, a second backwall, a floor, a lid, an elevating platform and a guide, wherein the third and fourth sidewalls contain slots therein for receiving the guide and wherein the lid is pivotally mounted to the rear storage compartment and wherein the elevating platform is connected to the frontwall assembly via the linkage assembly such that when the frontwall assembly is pivoted away from the front storage compartment the elevating platform rises.

6. The storage device of claim 5, wherein the retention assembly comprises an elastic band.

7. The storage device of claim 5, wherein the retention assembly comprises first and second retention sidewalls, a keeper wall and a retention floor.

* * * * *